US006256833B1

(12) United States Patent
Steinberg

(10) Patent No.: US 6,256,833 B1
(45) Date of Patent: Jul. 10, 2001

(54) UPRIGHT VACUUM CLEANER WITH HANDLE-MOUNTED LAMP ASSEMBLY AND HEIGHT ADJUSTMENT

(75) Inventor: Gary L. Steinberg, Jenison, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 09/487,407

(22) Filed: Jan. 19, 2000

Related U.S. Application Data

(60) Provisional application No. 60/116,466, filed on Jan. 20, 1999.

(51) Int. Cl.[7] ..... A47L 9/30
(52) U.S. Cl. ..... 15/325; 15/361
(58) Field of Search ..... 15/325, 333, 360

(56) References Cited

U.S. PATENT DOCUMENTS

| | | | | |
|---|---|---|---|---|
| D. 396,902 | | 8/1998 | Fedorka et al. . | |
| 2,575,554 | | 11/1951 | Langille . | |
| 3,188,681 | * | 6/1965 | Jepson et al. | 15/324 X |
| 3,579,699 | * | 5/1971 | Balzer | 15/361 |
| 3,713,185 | * | 1/1973 | Lowers et al. | 15/361 X |
| 4,217,674 | * | 8/1980 | Hayashi et al. | 15/361 |
| 4,329,757 | | 5/1982 | Ramstrom et al. . | |
| 4,757,574 | | 7/1988 | Sumerau . | |
| 4,791,700 | | 12/1988 | Bigley et al. . | |
| 4,831,683 | * | 5/1989 | Kroll et al. | 15/361 |
| 4,905,341 | * | 3/1990 | Sunagawa et al. | 15/324 X |
| 5,107,565 | | 4/1992 | Chun . | |
| 5,207,498 | | 5/1993 | Lawrence et al. . | |
| 5,467,501 | | 11/1995 | Sepke . | |
| 6,098,242 | * | 8/2000 | Choi | 15/361 |

* cited by examiner

*Primary Examiner*—Chris K. Moore
(74) *Attorney, Agent, or Firm*—Rader, Fishman, Grauer & Mc Garry, An Office of Rader, Fishman & Grauer PLLC

(57) ABSTRACT

An upright vacuum cleaner includes a handle pivotally mounted to a base module, a lower portion of the handle mounts a lamp assembly which is hidden from view by the base module when the handle is in an upright, storage position and is visible above the base module when the handle is rotated to a use position. Between the front and back of the base module, a set of wheels or other projections that support the base module are mounted. The handle likewise has at a lower portion a set of wheels that mobilize the vacuum cleaner. In one embodiment, the pivot axis of the handle with respect to the base is selected so that rotation of the handle assembly from a use position to a storage position pivots a front end of the base module about the base wheels and thereby raises an agitation brush from contact with a surface to be cleaned. The rotation of the handle assembly with respect to the base module to its use position, moves the lamp assembly mounted therein from a hidden position behind a shroud in the base module to an exposed position above the base module for illuminating the surface to be cleaned immediately adjacent the front end of the base module.

8 Claims, 5 Drawing Sheets

UPRIGHT VACUUM CLEANER WITH HANDLE-MOUNTED LAMP ASSEMBLY AND HEIGHT ADJUSTMENT

CROSS REFERENCE TO RELATED APPLICATION

This application claims the benefit of U.S. Provisional Application No. 60/116,466, filed Jan. 20, 1999.

BACKGROUND OF THE INVENTION

1. Field of the Invention

This invention relates to upright vacuum cleaners and, more particularly, to upright vacuum cleaners having a pivotable handle and a lamp assembly. In one of its aspects, the invention relates to an upright vacuum cleaner having a combined concealible lamp and height adjustment mechanism. In another of its aspects, the invention relates to an upright vacuum cleaner with a height control adjustment for a nozzle and agitator.

2. State of the Prior Art

Upright vacuum cleaners include a handle mounted to a base and pivotable between an inclined use position and a generally vertical storage position. Where such vacuum cleaners include an agitation brush it is typical to have a handle-actuated mechanism for lifting the rotating agitation brush from the surface to be cleaned when the handle is in the upright or storage position. In this way, potential damage to the surface is avoided by disengaging the rotating brush from the surface. These mechanical links to the handle for raising and lowering the brush are often complex, resulting in increased manufacturing costs and a greater probability for malfunction. Eliminating or reducing the complexity of the mechanical actuating link responsive to handle position would reduce overall costs and provide a more reliable vacuum cleaner.

Upright vacuum cleaners including a pivotal handle attached to a base module often include a lamp assembly including a lens and lamp mounted to the base module. The lamp is typically illuminated when power to the upright vacuum cleaner is provided. It is also known to include a lamp mounted to a lower portion of the handle with the lens mounted to the base so that, when the handle is in the upright or storage position, the lamp behind the lens and the hood is dimmed or blocked and, when the handle is tilted rearward to an in-use position, the lamp rotates upwardly with the lower handle portion whereby it emerges from behind the hood and illuminates the lens. Where the lamp assembly is mounted to the base module the overall profile of the base module is increased, making it difficult for vacuuming beneath furniture such as sofas. Where the lens and lamp assembly are separately mounted to the base module and lower portion of the handle, the profile is similarly not reduced because of the lens housing. Reducing the profile eases use of the vacuum cleaner, particularly for tasks such as cleaning beneath furniture.

SUMMARY OF THE INVENTION

According to the invention an upright vacuum cleaner includes a handle pivotally mounted to a base module, a lower portion of the handle mounts a lamp assembly which is hidden from view when the handle is in an upright, storage position and is visible when the handle is rotated to a use position. Between the front and back of the base module, a set of wheels or other projections which support the base module are mounted. The handle likewise has at a lower portion a set of wheels which mobilize the vacuum cleaner. In one embodiment, the pivot axis of the handle with respect to the base is selected so that rotation of the handle assembly from a use position to a storage position pivots a front end of the base module about the base wheels and thereby raises an agitation brush from contact with a surface to be cleaned. The rotation of the handle assembly with respect to the base module to its use position, moves the lamp assembly mounted therein from a hidden position behind a shroud in the base module to an exposed position above the base module for illuminating the surface to be cleaned immediately adjacent the front end of the vacuum cleaner.

Further, according to the invention, an upright vacuum cleaner has a base module with a suction nozzle at a forward portion and a handle pivotally mounted to the base module for pivotal movement about a pivot axis between an upright stored position and reclining use position. A pair of wheels supports the base for movement along a surface to be cleaned. A filter bag is mounted to the handle for recovering dirt from the dirty air. A suction motor is mounted to the handle or the base and has an inlet connected to the suction nozzle through a working air conduit for drawing air through the nozzle and to the filter bag for recovery of dirt. In one embodiment, the cleaning system is a dirty air system wherein the outlet of the suction motor is connected to the filter bag. In another aspect, the cleaning system is a clean air system wherein the inlet of the suction motor is connected to the filter bag whereby the air is drawn from the suction nozzle, through a working air conduit, through the filter bag and to the suction motor.

A lamp housing is formed on the lower portion of the handle and a lamp assembly is mounted in the lamp housing. The lamp assembly includes a lens that is mounted to a front portion of the lamp housing to project light from the lamp housing forwardly of the front of the base module during use of the vacuum cleaner. Preferably, the lens is mounted in an opening in the housing. Alternatively, the lens can be integrally formed in the lens housing.

The base module includes a shroud at a rear portion adjacent the lamp housing. The lens is so positioned in the lamp assembly and the pivot axis of the handle with respect to the base is selected so that the lens is positioned behind the shroud and thus substantially not visible to the user when the handle is in the upright stored position and the lens is positioned above the shroud and thus visible when the handle is in the reclining use position. Typically, the pivot axis is positioned between the handle heels and the base module wheels or projection.

In a preferred embodiment of the invention, the wheels are mounted on the handle. Further, the suction motor is preferably mounted on a lower portion of the handle and, preferably, in the lens housing. The lens housing front portion is arcuate in shape and has an axis of rotation concentric with the pivot axis between the axle and the base module.

In one embodiment of the invention, the handle is pivotally mounted to a rear portion of the base module and one or more base module supports, preferably in the form of wheels, are mounted on the central portion of the base module to support the base module on a floor. Wheels are also mounted on the handle. An agitator is mounted to the front portion of the base module. The pivot point of the handle with respect to the base module is selected so that the rotation of the handle from reclining use position to upright storage position pivots the front portion of the base upwardly about the base projecting supports or wheels to move the agitator from contact with the floor to a raised position above the floor. The agitator typically is an elongated cylindrical brush which is mounted for rotation about a horizontal axis. Other types of agitators such as reciprocal agitators and multiple brushes mounted on vertical axes can also be employed.

DETAILED DESCRIPTION OF THE PREFERRED EMBODIMENTS

Figure 1:
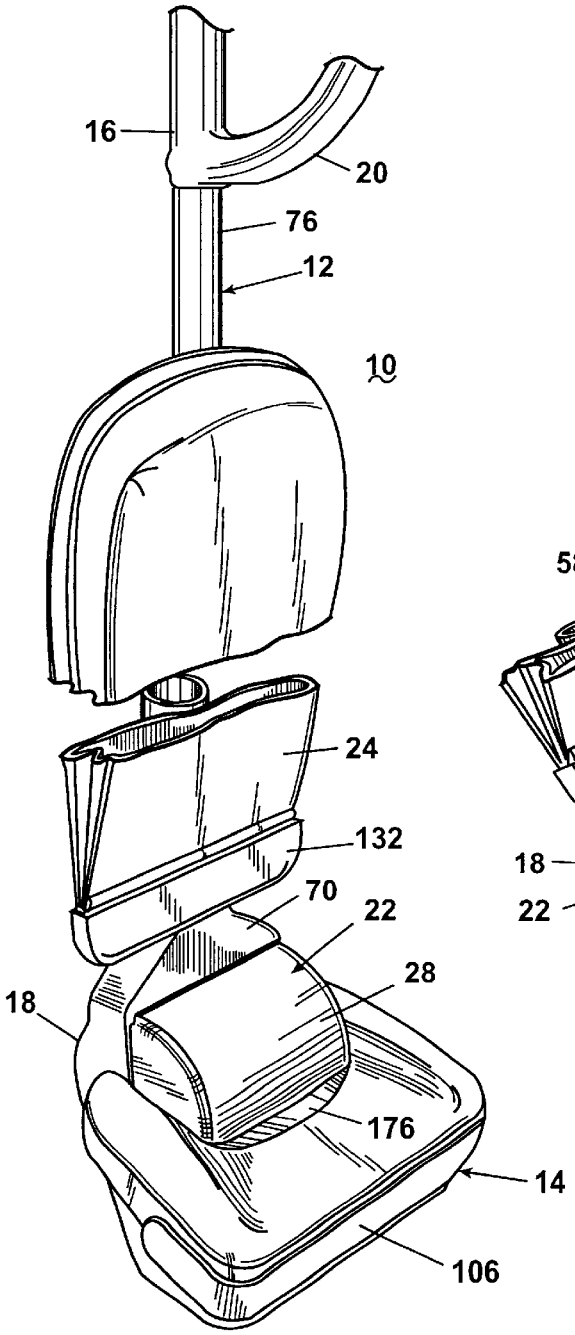
FIG. 1 is a partial perspective view of an upright vacuum cleaner according to the invention with the handle assembly in the upright or storage position.
Figure 2:
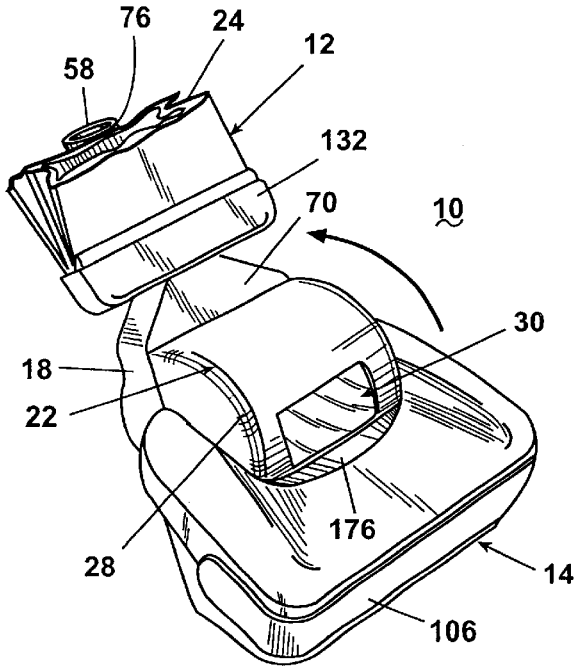
FIG. 2 is a partial perspective view of the upright vacuum cleaner of FIG. 1 with the handle assembly tilted rearwardly to an in-use position.
Figure 3:
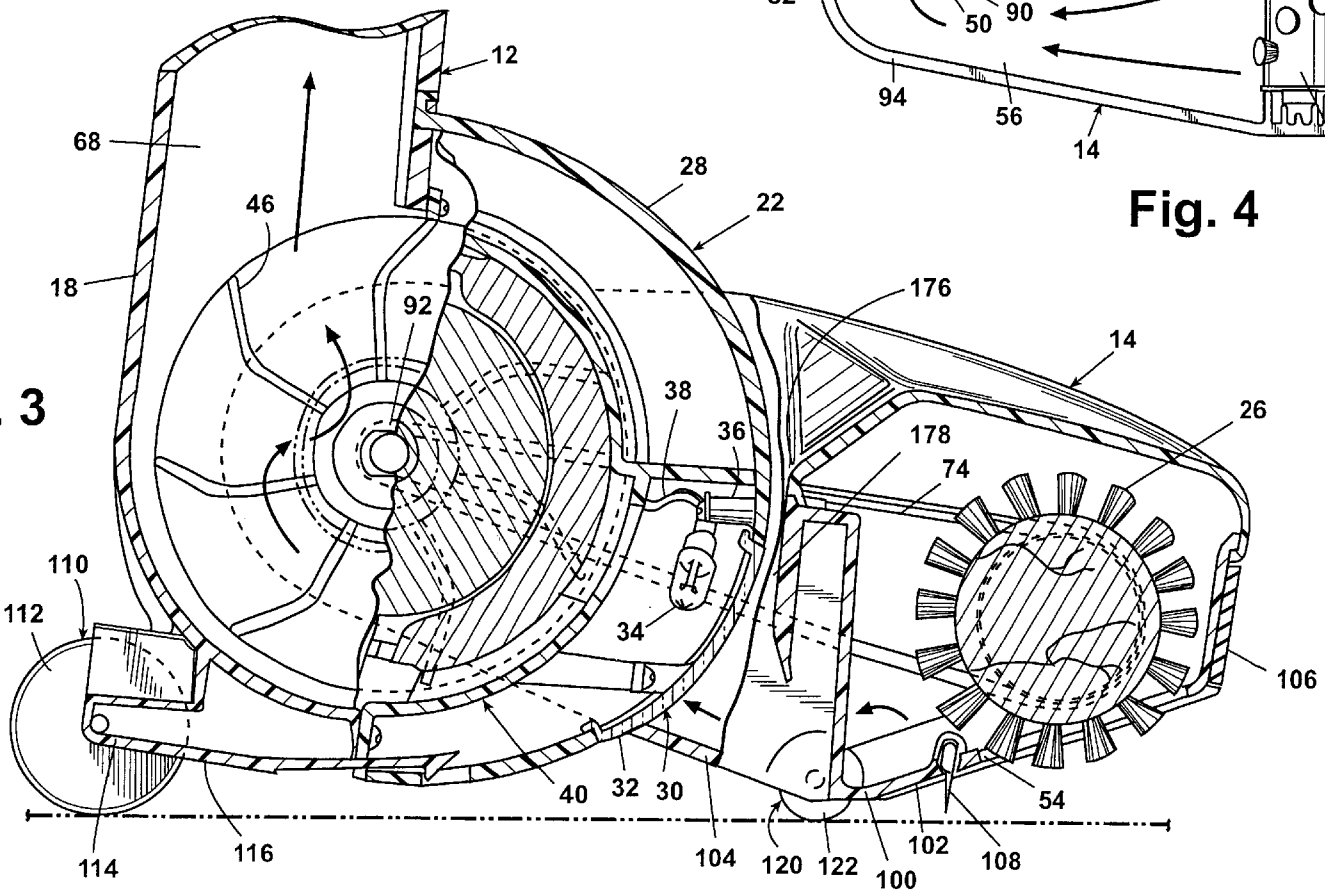
FIG. 3 is a partial sectional side view of the upright vacuum cleaner along line 3—3 of FIG. 1.

With reference to FIGS. 1–3, an upright vacuum cleaner 10 is illustrated and includes a handle assembly 12 pivotally connected to a base module 14. More specifically, the handle assembly 12 includes an upper end 16 including a hand grip 20 and a lower end 18 including an arcuate motor and lamp housing 22. Between the upper end 16 and lower end 18 is mounted a soft collection bag 24. The base module 14 includes a front end housing an agitation brush 26 and a rear end including a 5 pivotal connection to the arcuate motor and lamp housing 22 of the handle assembly 12. The bag 24 is porous and exhausts air that flows to the bag 24. Housed with the bag 24 is a filter bag (not shown) which captures dirt and debris from the air which enters the filter bag in conventional fashion. The invention also contemplates a hard impervious bag housing and a filter bag mounted within the hard impervious bag housing for a clean air system as, for example, disclosed in the Jailor U.S. Pat. No. 5,544,385 which is incorporated herein by reference. In the clean air system, the dirty air is drawn through the filter bag by a suction motor.

Figure 6:
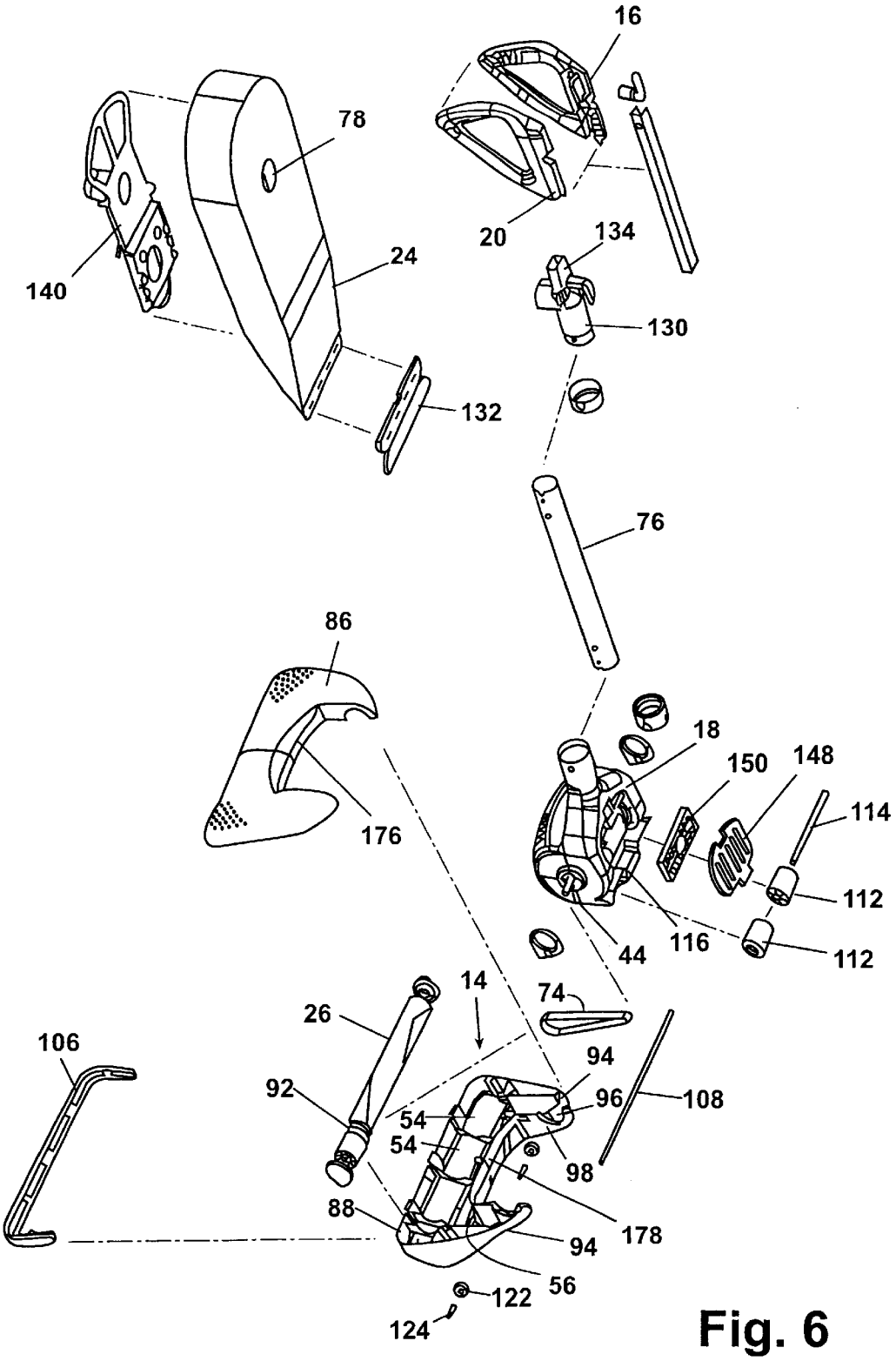
FIG. 6 is an exploded view of the upright vacuum cleaner of FIG. 1.

With further reference to FIG. 6, the handle assembly 12 includes a tubular member 76 connecting the upper and lower ends 16, 18. The tubular member 76 is hollow and defines an air passageway 58 extending from the motor and lamp housing 22 at the lower end 16 to an inlet port 78 to the collection bag 24, disposed just below the hand grip 20 at the upper end 18 of the handle assembly 12. Specifically, the tubular member 76 connects the motor and lamp housing 22 to an elbow connector 130 at the inlet port 78. The hand grip 20, preferably a two-piece assembly joined by conventional fasteners, is mounted to a stake 134 extending from an upper portion of the elbow connector 130.

The collection bag 24 houses a conventional filter bag (not shown) for the collection of dirt and debris separated from the working air exhausted through the bag 24. The collection bag 24 is supported at an upper end by the elbow connector 130, and at a lower end by a clip 132 attached to tabs 54 on the motor and lamp housing 22 The collection bag 24 includes a frame 140 mounting to the elbow connector 130, maintaining the shape of the collection bag 24, and securing a disposable filter bag (not shown) within the collection bag 24.

Figure 4:
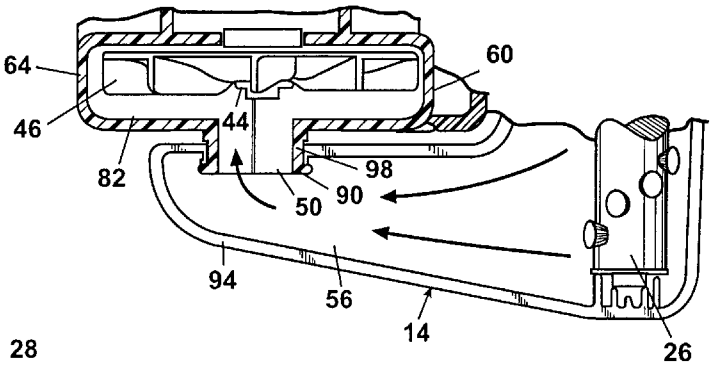
FIG. 4 is a partial sectional top view of the upright vacuum cleaner along line 4—4 of FIG. 1.
Figure 5:
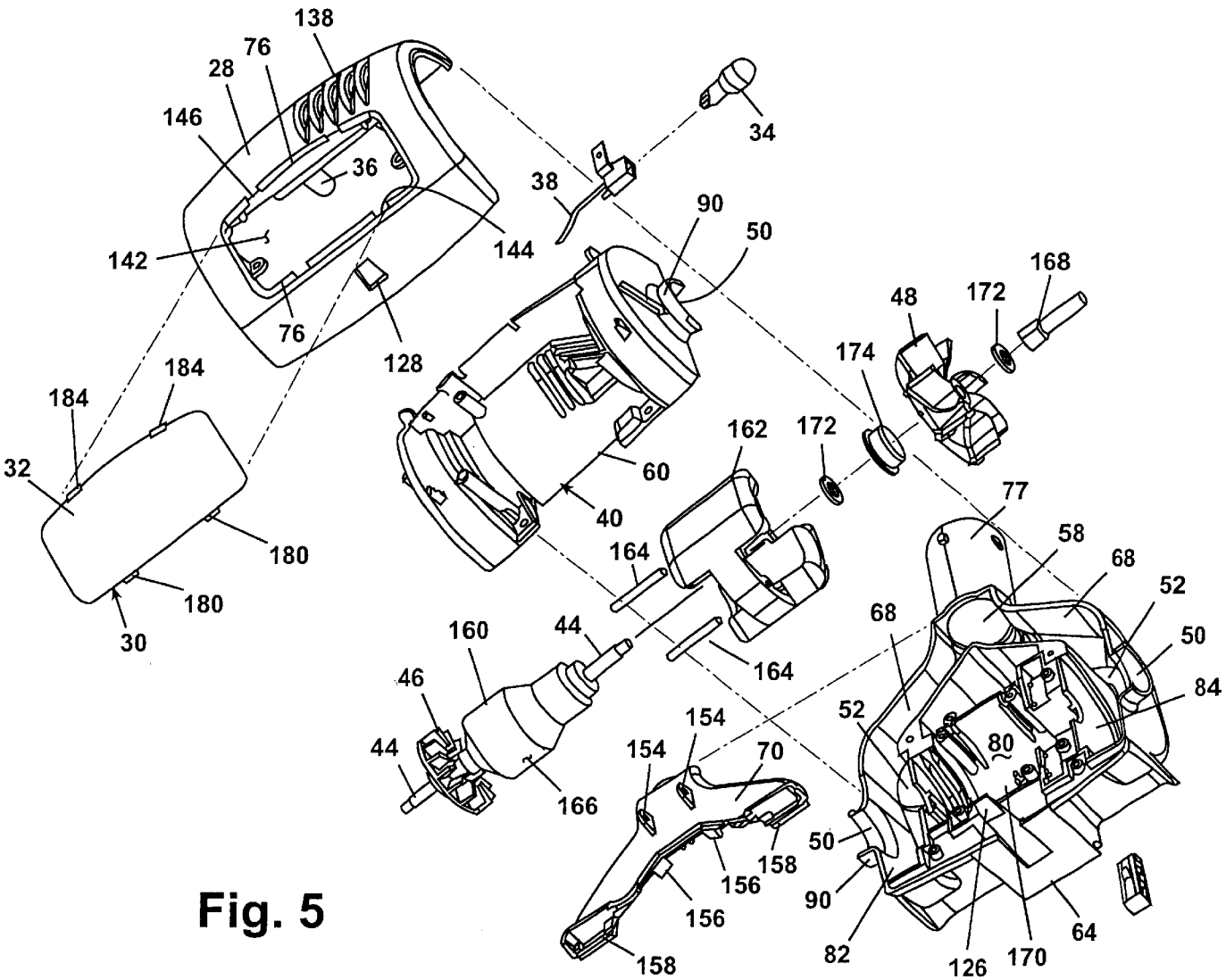
FIG. 5 is an exploded view of the lower end of the handle assembly of the upright vacuum cleaner of FIG. 1.

With reference to FIGS. 3–5, the arcuate motor and lamp housing 22 of the handle assembly 12 includes an outwardly convex housing portion 28 on the lower end 18 of the handle assembly 12. The motor and lamp housing 22 mounts a lamp assembly 30 through the housing portion 28 and a motor/fan casing 40 within the housing portion 28. The motor/fan casing 40 houses a suction motor comprising a motor 42 which rotatably drives impellers 46, 48 via a drive shaft 44. The suction motor provides a suction source for the collection of dirt and debris, and the drive shaft 44 includes a pulley 72 for rotatably driving the agitation brush 26 about a horizontal axis in the base module 14 through a connecting belt 74. The portion of the drive shaft 44 including the pulley 72 extends from the motor/fan casing 40 into the base module 14 to facilitate the driving connection through belt 74. Other types of agitation members can be used in lieu of the horizontally rotating agitation brush 26, including reciprocating agitators and brushes which rotate about a vertical axis.

Referring to FIGS. 3 and 6, a bottom rear portion of the handle assembly 12 mounts a first wheel assembly 110 for mobilizing the vacuum cleaner 10. The wheel assembly 110 includes a pair of wheels 112 rotatably mounted on an axle 114 secured to the handle assembly 12 through a rearwardly disposed mounting bracket 116. Further, a filter 150 for motor 42 is positioned in the housing at a rear portion of the motor and lamp housing 22. The motor further has a vented cover 148.

As best illustrated in FIG. 6, the base module 14 is a generally U-shaped, two-piece assembly comprising a top shell 86 mated to a bottom shell 88, preferably fastened together by screws or other conventional fasteners. Together, the top and bottom shells 86, 88 mount the agitation brush 26 in a forward portion 102 for rotation about a horizontal axis and define working air passageways 56 extending rearwardly from suction inlet openings 54 formed adjacent the brush. The brush 26 is mounted for rotation between the top and bottom shells 86, 88 to agitate the surface being cleaned through the inlet openings 54. The brush 26 is driven by the motor 42 and includes a circumferential groove 92 in its exterior surface for receiving the motor-driven belt 74. A strip brush or wiper blade 108 can advantageously be positioned rearward of the agitation brush 26.

As shown further in FIG. 3, the bottom shell 88 includes a wide medial portion 100 narrowing forwardly and rearwardly at an acute angle relative a surface to be cleaned. The medial portion 100 mounts a second wheel assembly 120 for mobilizing the base module 14. The second wheel assembly 120 includes a pair of wheels 122 rotatably mounted on an axle 124 secured to the base module 14. The forward portion 102 of the bottom shell 88 includes the inlet openings 54 therethrough, and preferably ends with a bumper 106 at a foremost portion. A rearward portion 104 of the U-shaped base comprises spaced arms 94 accommodating the motor and lamp housing 22 of the handle assembly 12 and narrowing toward the pivotal connection to the handle assembly 12. Specifically, the arms 94 include sockets 96 formed in an interior surface and each defined by a bearing 98 for pivotally mounting the handle assembly 12 for rotation of the handle with respect to the base about a pivot axis through the shaft 44. The radius of curvature R of the motor and lamp housing 22 has a center at the pivot axis through the shaft 44. The top shell 86 has a shroud 176 at a rear central portion which mates with a shroud 178 at a rear central portion of the bottom shell 188.

As best shown in FIG. 5, the motor/fan casing 40 is a two-piece construction including a front shell 60 mated to a rear shell 64, preferably fastened together by screws or other conventional fasteners. The front shell 60 is a generally semicircular cross-sectioned cradle portion 62 mated to receive the motor 42 and impellers 46, 48. The rear shell 64 similarly includes a cradle portion 66 mated to receive the motor 42 and impellers 46, 48, and further includes fluid passageways 68 defined in cooperation with a cover 70. The fluid passageways 68 converge to the fluid passageway 58, which is partially defined by a tubular end portion 77 of the rear shell 66 and further connected to tubular member 76 of the handle assembly 12. The cover 70 includes the tabs 154 for securing the lower end of the collection bag 24, as well as clips 156 for reception in slots (not shown) formed on the motor/fan casing 40. Finally, the cover 70 includes wells 158 formed in opposite foremost arms thereof for receiving opposite end portions of front shell 60 partially defining impeller chambers 82, 84.

Together, the front and rear shells 60, 64 define a motor chamber 80, impeller chambers 82, 84, as well as an exit opening 52 between each impeller chamber 82, 84 and the respective fluid passageway 68 and an inlet opening 50 at the axial end of each impeller chamber 82, 84. The inlet openings 50 are each defined by a collar 90, which journal in the respective bearings 98 formed in distal ends of the anns 94 of the base module 14 to facilitate rotation of the handle assembly 12 relative the base module 14. With reference to FIG. 4, the inlet opening 50 to the impeller chamber 82 is fluidly connected through the air passageway 56 in the base module to the suction inlet opening 54 formed adjacent the agitation brush 26. While only one side is shown, the illustration applies equally well to the opposite side where the inlet opening 50 to impeller chamber 84 is fluidly connected through the air passageway 56 in the base module to the suction inlet opening 54 formed adjacent the agitation brush 26. The air passageway 58 fluidly connects the impeller chambers 82, 84, via passageways 68, to the collection bag 24.

Within the motor chamber 80 defined by the front and rear shell 60, 64 is mounted the motor 42 generally comprising a rotor 160 mounted co-axially within a stator coil 162 for rotating shafts 44 for the impeller fans 46, 48. The rotor 160 is mounted co-axially within the stator coil by pins 164, which are secured against a bearing surface on the stator coil 162 and roll against their cylindrical surface 166 on the rotor 160 to permit the stator coil 162 to rotationally drive the rotor 160 therein. The stator coil 162 is statically mounted within pocket 170 of motor chamber 80. The drive shaft 44 for impeller fan 48 includes a coaxial extension forming a pulley 168 for receiving the belt 74 for driving the agitation brush 26. The impeller fans 46, 48 are co-axially secured to the drive shaft 44. A retaining bearing 174 spaces the respective impeller fin 46, 48 from each end of the rotor 160. Further, washers 172 are disposed between the retainer bearings 174 and the respective impeller fans 46, 48, as well as between the co-axial extension for pulley 168 and the impeller fan 48.

The lamp assembly 30 includes a lamp 34 mounted in the space between the generally concentric portions of the motor/fan casing 40 and the housing portion 28, which includes an aperture 142 therein covered by a lens 32. The lens 32 is supported in the aperture 142 by a rim 76 that surrounds the aperture 142. This rim 76 has lower slots 144 and upper slots 146. The lens 32 has lower projections 182 that fit into the lower slots 144 and upper projections 184 that fit within the upper slots 146. Although shown as a separate piece mounted in the aperture 142 in the motor and lamp assembly housing 22, the lens can be integrally molded with the motor and lamp assembly housing 22. The lamp 34 is mounted on a post 36 extending radially inward from the housing portion 28 and aligned with the lens 32 to provide illumination therethrough when the upright vacuum cleaner 10 is electrically connected by wiring 38 to a source of power (not shown). As shown in FIG. 3, the lens 32 mounting to the motor casing 22 is on a lower portion of the motor and lamp housing 22 when the handle assembly 12 is in the upright or storage position, and thereby hidden from exterior view by the shrouds 176 and 178 of the base module 14. When the handle assembly 12, and thus the motor and lamp housing 22, is tilted rearwardly for use, the lamp assembly 30 is rotated therewith about the pivot axis through shafts 44 to a visible position above the shrouds 176 and 178 of the base module 14, whereby the lamp assembly 30 illuminates the area of the surface being cleaned immediately in front of the base module 14.

The housing portion 28 of the motor and lamp housing 22 mounts over the motor fan casing 40 to conceal it within the lower end 18 of the handle assembly 12. To mount the housing portion 28 to the handle assembly 12 an opening 128 is provided on a front lower portion of the housing portion 28 for receiving a resilient tab 126 formed on a front bottom portion of the rear shell 64. The resilient tab 126 is flexible such that when the housing portion 28 is placed over the rear portion 64 after the front shell 60 has already been secured to the rear shell 64, the tab 126 flexes inwardly until a top ramped portion thereof registers with the opening 128, at which point it returns to its natural rest position wherein an abutment adjacent the ramped portion locks the housing portion in place thereon. The opposite end of the housing portion 28 can be similarly secured to the rear shell 64, or cover 70, or can be secured to either any more conventional fashion, such as by screws or other fastener. Finally, the housing portion 28 includes a series of openings 138 on a top portion thereof providing ventilation for the motor 42.

The pivotal connection between the handle assembly 12 and the base module 14 is illustrated in FIGS. 3–6. Specifically, the collars 90 formed on opposite ends of the motor casing 40 formed within the motor and lamp housing 22 of the handle assembly 12 journal in the bearings 98 formed on the distal ends of the arms 94 of the base module 14. Together, the first and second wheel assemblies 110, 120 support and mobilize the vacuum cleaner 10. The rear wheel assembly 110 further functions as a pivot axis for rotation of the handle assembly 12 from a use position to a storage position, or vice versa.

Figure 7:
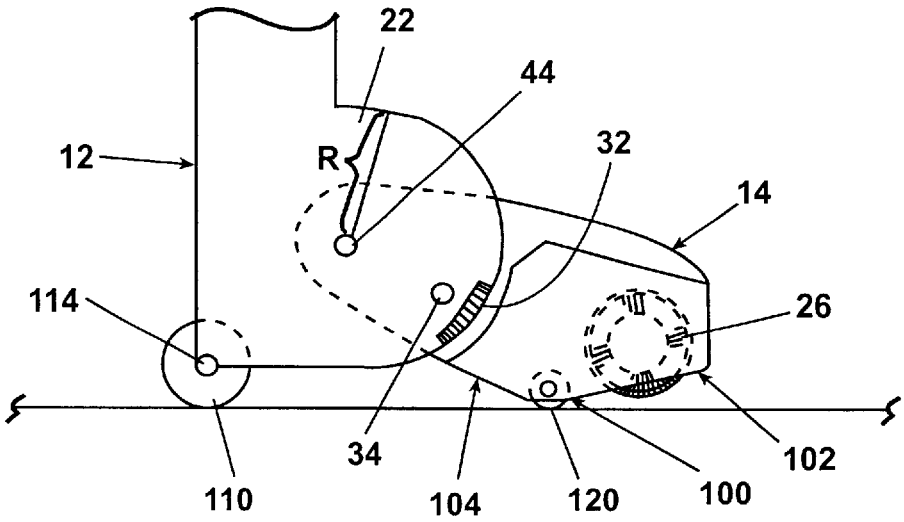
FIG. 7 is a diagrammatic side view of the upright vacuum cleaner of FIG. 1 with the handle assembly in the upright or storage position.

The handle assembly 12 is shown in the storage position in FIGS. 1, 3 and 7, where the forward portion 102 of the base module 14 is at an acute angle relative the surface supporting the vacuum cleaner 10. Further, in this position, the axis of the axle 114 of the first wheel assembly 110 is rearward of the axis of the motor shaft 44. Counterclockwise rotation of the handle assembly 12 rearwardly to the use position, as illustrated by the arrow in FIGS. 2 and 8, forces the large wheel assembly 110, and thus the axis of the axle 114, forwardly toward vertical alignment with the axis of the motor shaft 44. During the rotation of the handle assembly 12, the motor and lamp housing 22 similarly rotates counterclockwise to elevate the lamp assembly 30 from behind the shrouds 176 and 178 of the base module 14. Coincidentally, during the counterclockwise rotation, the forward portion 102 is lowered toward the surface to be cleaned and supporting the vacuum cleaner 10, reducing the acute angle therebetween until the forward portion 102 is approximately parallel to the surface and the agitation brush 26 is in contact therewith.

Figure 8:
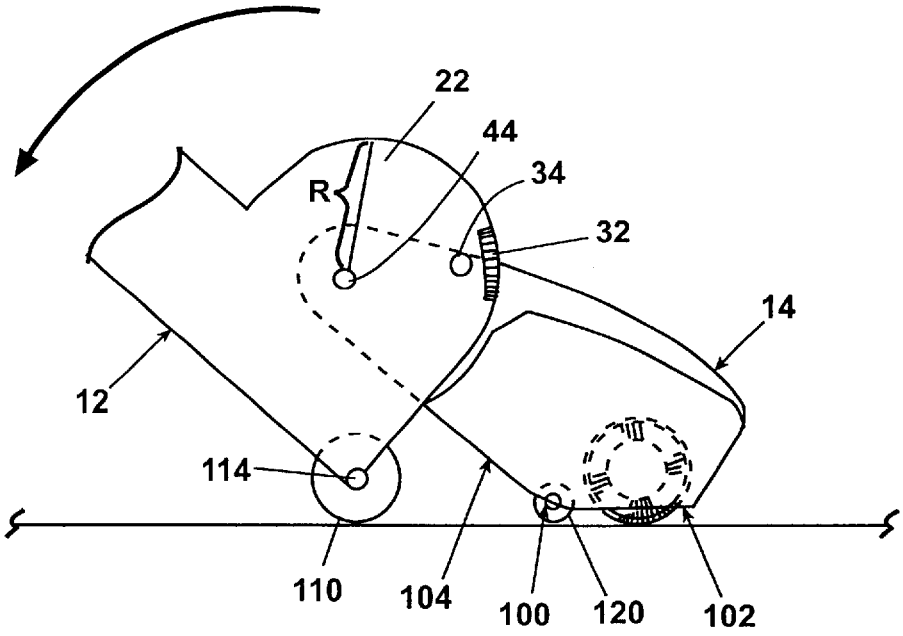
FIG. 8 is a diagrammatic side view of the upright vacuum cleaner of FIG. 1 with the handle assembly tilted rearwardly to an in-use position.

In the use position, demonstrated best by FIG. 8, the forward portion 102 is approximately parallel to the surface to be cleaned and the brush 26 agitates the surface to sweep dirt and debris from the surface for removal by suction through the inlet openings 54. Because the generally horizontal rotation axis for the motor drive shaft 44, which drives the agitation brush 26 through the belt 74, is coincident with the pivot axis for the handle assembly 12 and base module 14, there is no slackening or tensioning of the belt 74 during rotation of the handle assembly 12 from the storage and use positions. The working air generated by the impellers 46, 48 rotated by the motor 42 causes an area of low pressure adjacent the inlet openings 54, whereby dirt and debris are drawn through the inlet openings 54, the air passageways 56 formed in opposite sides of the base module 14, the inlet opening 50 formed through the collars 90 and bearings 98 making the pivotal connection of the base module 14 and handle assembly 12, and toward the impellers 46, 48 in chambers 82, 84 in the motor and lamp housing 22 of the handle assembly 12. From the chambers 82, 84, the air carrying dirt and debris is propelled through the converging air passageways 68 in the motor and lamp housing 22 of the handle assembly 12 toward the air passageway 58 in tubular portion 77 on the lower end 18 of the handle assembly 12, and through tubular member 76, elbow connector 130, and inlet port 78 to the collection bag 24. The disposable filter bag (not shown), as well as the collection bag 24 itself, separate the dirt and debris from the working air.

Through the simple pivotal connection of the handle assembly 12 to the base module 14, the vacuum cleaner 10 is converted from storage to use positions. Rotation of the handle assembly 12 with respect to the base module 14 to the use position, rotates the base module about the axis of wheels 120 and thus brings the agitation brush 26 into contact with the surface to be cleaned. In this movement, the height of the rear portion 104 of the base module 14 is pivoted upwardly about the axis of the wheel assembly 120 so that the nozzle is approximately parallel and in close proximity to the surface to be cleaned. The same rotation of the handle assembly 12 disposes the lamp assembly 30 in an exposed position above the base assembly 14 for illuminating the surface to be cleaned immediately adjacent the front end of the vacuum cleaner 10. The motor and lamp housing 22 of the handle assembly 12 rotates counterclockwise therewith to a use position, moving the lamp assembly 30 mounted therein from its hidden position behind the base module 14 to an exposed position above the base module 14.

The above-described construction is particularly effective in eliminating a complex assembly for lifting the agitation brush from contact with a surface to be cleaned when the handle is in the storage position and providing illumination only when the handle is in the in-use position without providing switches for the electrical circuitry connecting the bulb to a power source. Where the upright vacuum cleaner includes a vacuum motor mounted in the lower portion of the handle, it is particularly useful to keep the lamp assembly in close proximity to the motor to reduce the length of the electrical connections and avoid routing the electrical connections through the pivotal connection of the handle to the base.

Whereas the invention has been disclosed with respect to a vacuum cleaner with a suction motor mounted on the handle for rotation therewith, the suction motor can be mounted on the base module as well. Further, the invention has been described with respect to a second pair of wheels 120 mounted to the underside of the base, one or more projections can be used in lieu of the wheels to support the base module on the floor and the base module can rotate about the one or more projections as the handle is rotated with respect to the base module in the same manner as the wheels 120.

While particular embodiments of the invention have been shown, it will be understood that the invention is not limited thereto since reasonable variation and modifications are possible without departing form the scope of the forgoing disclosure and drawings, particularly in light of the foregoing teachings, without departing from the spirit of the invention which is defined in the appended claims.

What is claimed is:

1. An upright vacuum cleaner having a base module and a handle pivotally mounted thereto for pivotal movement about a pivot axis between an upright stored position and a reclining use position;

the base module having a suction nozzle at a forward portion thereof;

at least one pair of wheels supporting the base for movement along a surface to be cleaned;

a filter bag mounted to the handle for recovering dirt from dirty air;

a suction motor mounted to one of the handle and the base and having an inlet connected to the suction nozzle and to the filter bag for drawing air from the suction nozzle, through a working air conduit and to the filter bag;

a lamp housing on the lower portion of the handle;

a lamp assembly mounted in the lamp housing and a lens mounted to a front portion of the lamp housing to project light from the lamp forwardly in front of the base module during use;

the base module including a shroud adjacent the lamp housing; the improvement which comprises:

the pivot axis of the handle with respect to the base is positioned so that the lens is positioned behind the shroud and thus not substantially visible to a user when the handle is in the upright stored position and the lens is positioned above the shroud and thus visible when the handle is in the reclining use position.

2. An upright vacuum cleaner according to claim 1 and further comprising a soft porous bag enclosing the filter bag and the suction motor has an outlet connected to the filter bag.

3. An upright vacuum cleaner according to claim 1 and further comprising a hard impervious housing enclosing the filter bag and the suction motor inlet opening is also connected to the filter bag to draw dirty air into the filter bag.

4. An upright vacuum cleaner according to claim 1 wherein the lens is mounted to an opening in the front portion of the lamp housing.

5. An upright vacuum cleaner according to claim 1 wherein the suction motor is mounted to the handle.

6. An upright vacuum cleaner according to claim 5 wherein the lamp housing front portion is arcuate in shape and has a center of curvature concentric with the pivot axis between the handle and the base module.

7. An upright vacuum cleaner according to claim 1 wherein the handle is pivotally mounted to a rear portion of the base module;

at least one support is provided on the central portion of the base module to support the base module on a floor surface;

the wheels are mounted on the handle;

an agitator is mounted on a front portion of the base module; and the pivot axis between the handle and the base module is further positioned so that rotation of the handle from a reclining use position to an upright storage position pivots the front portion of the base upwardly about the at least one support to move the agitator from contact with the floor to a raised position above the floor.

8. An upright vacuum cleaner according to claim 7 wherein the at least one support comprises a pair of wheels mounted to an underside of the base module.

* * * * *